US007842353B2

(12) United States Patent
Cao et al.

(10) Patent No.: US 7,842,353 B2
(45) **Date of Patent: *Nov. 30, 2010**

(54) MANUFACTURING PROCESS OF ELECTRODES FOR ELECTROLYSIS

(75) Inventors: Yi Cao, Fujisawa (JP); Hajime Wada, Fujisawa (JP); Masashi Hosonuma, Fujisawa (JP)

(73) Assignee: Permelec Electrode Ltd., Fujisawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/381,979

(22) Filed: Mar. 18, 2009

(65) Prior Publication Data

US 2009/0242417 A1 Oct. 1, 2009

(30) Foreign Application Priority Data

Mar. 31, 2008 (JP) ..... 2008-089251

(51) Int. Cl.

| | |
|---|---|
| ***C23C 14/30*** | (2006.01) |
| ***C23C 14/58*** | (2006.01) |
| ***B05D 3/02*** | (2006.01) |
| ***B05D 5/12*** | (2006.01) |

(52) U.S. Cl. ..... 427/528; 427/531; 427/580; 427/78; 427/124; 427/125; 427/126.3; 427/126.5; 427/226; 427/376.3; 427/383.3; 204/192.38

(58) Field of Classification Search ..... None
See application file for complete search history.

(56) References Cited

U.S. PATENT DOCUMENTS 3,933,616 A 1/1976 Beer
4,052,271 A 10/1977 Beer (Continued)

FOREIGN PATENT DOCUMENTS

JP 57-192281 A 11/1982

(Continued)

OTHER PUBLICATIONS

SGTE alloy phase diagrams,copy Ta-Ti phase diagram, from www.crct.polymtl.ca/FACT/documentation/SGTE/SGTE_Figs.htm (with copies exemplary calculations from web site), Ta-Ti databases revised 2004 (no month).*

(Continued)

*Primary Examiner*—Marianne L Padgett
(74) *Attorney, Agent, or Firm*—Chapman and Cutler LLP

(57) ABSTRACT

A process for manufacturing electrodes for electrolysis, including steps of forming an arc ion plating (AIP) undercoating layer including valve metal or valve metal alloy containing a crystalline tantalum component and a crystalline titanium component on a surface of the electrode substrate comprising valve metal or valve metal alloy, by an arc ion plating method; heat sintering, including the steps of coating a metal compound solution, which includes valve metal as a chief element, onto the surface of the AIP undercoating layer, followed by heat sintering to transform only the tantalum component of the AIP undercoating layer into an amorphous substance, and to form an oxide interlayer, which includes a valve metal oxides component as a chief element, on the surface of the AIP undercoating layer containing the transformed amorphous tantalum component and the crystalline titanium component; and forming an electrode catalyst layer on the surface of the oxide interlayer.

6 Claims, 2 Drawing Sheets

U.S. PATENT DOCUMENTS

| | | | | |
|---|---|---|---|---|
| 4,469,581 | A | 9/1984 | Asano et al. | |
| 4,484,999 | A | 11/1984 | Asano et al. | |
| 5,059,297 | A | 10/1991 | Hirao et al. | |
| 5,593,556 | A | 1/1997 | Kumagai et al. | |
| 7,232,508 | B2 * | 6/2007 | Hosonuma | 204/290.12 |
| 2003/0148145 | A1 * | 8/2003 | Yamamoto et al. | 428/698 |
| 2003/0205304 | A1 * | 11/2003 | Yamada et al. | 148/578 |
| 2006/0182999 | A1 * | 8/2006 | Yamamoto | 428/698 |

FOREIGN PATENT DOCUMENTS

| | | | |
|---|---|---|---|
| JP | 59-038394 | A | 3/1984 |
| JP | 2-247393 | A | 10/1990 |
| JP | 2-282491 | A | 11/1990 |
| JP | 5-033177 | A | 2/1993 |
| JP | 5-171483 | A | 7/1993 |
| JP | 6-306669 | A | 11/1994 |
| JP | 7-090665 | A | 4/1995 |
| JP | 7-229000 | A | 8/1995 |
| JP | 2004-360067 | A | 12/2004 |
| JP | 2007-154237 | A | 6/2007 |
| JP | 2009-263770 | A * | 11/2009 |

OTHER PUBLICATIONS

European Patent Office, Extended European Search Report for European Patent Application No. EP 09 00 2769, Jun. 8, 2009, European Patent Office, Munich, Germany.

Database WPI Week 199311, Thomson Scientific, London, Great Britain; Class A60, AN 1993-089086 XP002525801, (abstract of JP 5-033177 A, pub. Feb. 1993).

* cited by examiner

MANUFACTURING PROCESS OF ELECTRODES FOR ELECTROLYSIS

BACKGROUND OF THE INVENTION

1. Field of the Invention

This application claims the priority of Japanese Patent Application 2008-89251 filed on Mar. 31, 2008, the teachings of which are incorporated herein by reference in their entirety. This invention relates to the manufacturing process of the electrodes for electrolysis to be applied for various kinds of electrolysis for the industrial purpose, especially relating to the manufacturing process of the electrodes for electrolysis with high durability in electrolysis for the industrial purposes including electrolysis copper foil manufacturing, aluminum electrolysis capacitor manufacturing by a liquid power feeding, and continuous galvanized iron sheet manufacturing, which is associated with oxygen generation at the anode.

2. Description of the Related Art

Recent electrolysis processes for the industrial purposes including electrolysis copper foil manufacturing, aluminum electrolysis capacitor manufacturing by a liquid power feeding, and continuous galvanized iron sheet manufacturing involve oxygen generation at the anode and therefore, anodes of metal titanium substrate coated with iridium oxide as electrode catalyst are widely applied for its high resistance to oxygen generation. In this type of electrolysis for the industrial purposes which involves oxygen generation at the anode, however, organic substance or impurity elements are added for stabilization of products, which causes various electrochemical and chemical reactions. These reactions may result in higher consumption of electrode catalyst due to an increased concentration of hydrogen ions (lower pH value) associated with oxygen generation. With electrode catalyst of iridium oxide, popularly applied for the case of oxygen generation, electrode consumption is considered to start from consumption of itself and concomitantly occurring corrosion of the electrode substrate by the same reason, and as a result of partial and internal consumption and detachment of electrode catalyst, electric current flows intensively onto remaining part of the electrode catalyst, and thus catalyst consumption proceeds continuously at accelerating pace.

Conventionally, in order to suppress corrosive dissolution of the electrode substrate and successive detachment of effective electrode catalyst from the electrode substrate, various processes are applied, typically such as installing an interlayer between the titanium substrate and the electrode catalyst layer. Such interlayer is selected to have an electrode activity lower than that of electrode catalyst layer and electron conductivity, designed to have a role to alleviate damages of the substrate by isolating the electrode substrate away from the oxygen generation area which causes corrosive electrolyte and lowered pH. As the interlayers satisfying these conditions, various processes are described in the patent documents shown below.

In Patent Document 1, an interlayer provided with tantalum and/or niobium oxide in a thickness between 0.001 $g/m^2$ and 1 $g/m^2$ as metal and provided with conductivity across the titanium oxide coating formed on the substrate surface was suggested.

In Patent Document 2, a valence-controlled semiconductor with oxides of tantalum and/or niobium added to oxides of titanium and/or tin was suggested. The processes described in Patent Document 1 and Patent Document 2 have been widely applied industrially.

In Patent Document 3, a metal oxide interlayer formed on an undercoating layer comprising amorphous layer without grain boundary on the substrate surface prepared by vacuum sputtering was suggested.

Recently, however, reflecting demand for high economic efficiency, operation conditions have grown more and more stringent and highly durable electrodes are requested. Under these circumstances, the processes to prepare an interlayer as described in Patent Documents 1-3 have not achieved sufficient effects desired.

In order to solve the problems associated with the preparation of interlayers in Patent Documents 1-3, a method to form an interlayer comprising a single layer of titanium oxide where a titanium electrode substrate itself is electro-oxidized so that the surface titanium on said electrode substrate is transformed into titanium oxide is disclosed in Patent Document 4.

With the electrode described in Patent Document 4, the interlayer formed by electro-oxidation is extremely thin to provide sufficient corrosion resistance; therefore, on the surface of said first interlayer prepared by electro-oxidization, the second thick titanium oxide single layer is additionally formed by thermo-decomposition process, on which the electrode catalyst layer is configured. However, the method described in Patent Document 4 is poor in workability, less economical, and not practical since it requires two processes, of works in preparing the interlayer; more specifically, electro-oxidization and thermo-decomposition, which require two completely different equipment and machinery.

In Patent Document 5, a highly corrosion resistant, dense interlayer which is able to tightly bond with the electrode substrate, comprising high-temperature oxide coating prepared by high-temperature oxidation treatment of the electrode substrate between the electrode substrate and the electrode catalyst was suggested.

According to Patent Document 5, the oxide coating prepared by high temperature oxidation of the electrode substrate is highly corrosion resistant and dense, and tightly bonded with the electrode substrate, thus protecting the electrode substrate and enabling to sufficiently support electrode catalyst comprising mainly oxides, through oxide-oxide bonding.

In Patent Document 6, an interlayer with a double-layered structure to further enhance the effects of the method in Patent Document 5, comprising metal oxide and high temperature oxide coating derived from the substrate by high temperature oxidation was suggested.

However, either of the methods by Patent Document 5 and Patent Document 6 is inadequate to form a highly corrosion resistant, dense interlayer enabling to tightly bond with the electrode substrate between the electrode substrate and the electrode catalyst and could not obtain electrodes for electrolysis with enhanced density, electrolytic corrosion resistance and conductive property.

[Patent Document 1] Japanese Patent Application Publication No. JP 60-21232 (B Patent Gazette) also published as Japanese Patent Application Publication No. JP 57-192281 A)

[Patent Document 2] Japanese Patent Application Publication No. JP 60-22074 (B Patent Gazette) also published as Japanese Patent Application Publication No. JP 59-038394 A)

[Patent Document 3] Japanese Patent Application Publication No. JP 2761751 (B Patent Gazette) also published as Japanese Patent Application Publication No. JP 2-247393 A)

[Patent Document 4] Japanese Patent Application Publication No. JP 7-90665 (A Patent Gazette)

[Patent Document 5] Japanese Patent Application Publication No. JP 2004-360067 (A Patent Gazette)

[Patent Document 6] Japanese Patent Application Publication No. JP 2007-154237 (A Patent Gazette)

SUMMARY OF THE INVENTION

The present invention aims to solve the problems of conventional technologies as above-mentioned and to provide electrodes for electrolysis with higher density, higher electrolysis corrosion resistance and enhanced conductivity and the manufacturing process of them for said various kinds of electrolysis for the industrial purpose.

In order to achieve said aims, the present invention, as the first means for solving the problems, is to provide a manufacturing process of the electrodes for electrolysis, characterized by the process to form an arc ion plating undercoating layer (hereafter called the AIP undercoating layer) comprising valve metal or valve metal alloy containing crystalline tantalum component and crystalline titanium component on the surface of the electrode substrate comprising valve metal or valve metal alloy by the arc ion plating method (hereafter called the AIP method), the heat sintering process in which metal compound solution containing valve metal as a chief element component is coated on the surface of the AIP undercoating layer, followed by heat sintering to transform tantalum component only of the AIP undercoating layer comprising valve metal or valve metal alloy containing crystalline tantalum component and crystalline titanium component into amorphous substance and to form an oxide interlayer comprising valve metal oxides component as a chief element on the surface of the AIP undercoating layer containing transformed amorphous tantalum component and crystalline titanium component, and the process to form electrode catalyst layer on the surface of said oxide interlayer.

The present invention, as the second means for solving the problems, is to provide a manufacturing process of the electrodes for electrolysis, characterized in that in said heat sintering process, the sintering temperature of said heat sintering process is 530 degrees Celsius or more and the sintering duration in said heat sintering is 40 minutes or more.

The present invention, as the third means for solving the problems, is to provide a manufacturing process of the electrodes for electrolysis, characterized in that in said heat sintering process, the sintering temperature of said heat sintering process is 550 degrees Celsius or more and the sintering duration in said heat sintering is 60 minutes or more; only tantalum component of said AIP undercoating layer is transformed into amorphous substance; and at the same time valve metal component is partially oxidized.

The present invention, as the fourth means for solving the problems, is to provide a manufacturing process of the electrodes for electrolysis, characterized in that the metal oxides forming the oxide interlayer containing said valve metal component is at least one kind of metal oxides chosen from among titanium, tantalum, niobium, zirconium and hafnium.

The present invention, as the fifth means for solving the problems, is to provide a manufacturing process of the electrodes for electrolysis, characterized in that at the time of forming said electrode catalyst layer, said electrode catalyst layer is formed by the thermal decomposition process.

The present invention, as the sixth means for solving the problems, is to provide a manufacturing process of the electrodes for electrolysis according to claim 1, characterized in that the electrode substance comprising said valve metal or valve metal alloy is titanium or titanium base alloy.

The present invention, as the seventh means for solving the problems, is to provide the manufacturing process of the electrodes for electrolysis, characterized in that valve metal or valve metal alloy forming said AIP undercoating layer is composed of at least one kind of metals chosen from among niobium, zirconium and hafnium, together with tantalum and titanium.

DETAILED DESCRIPTION OF THE INVENTION AND PREFERRED EMBODIMENTS

The following is detailed explanation of the present invention.

Figure 1:
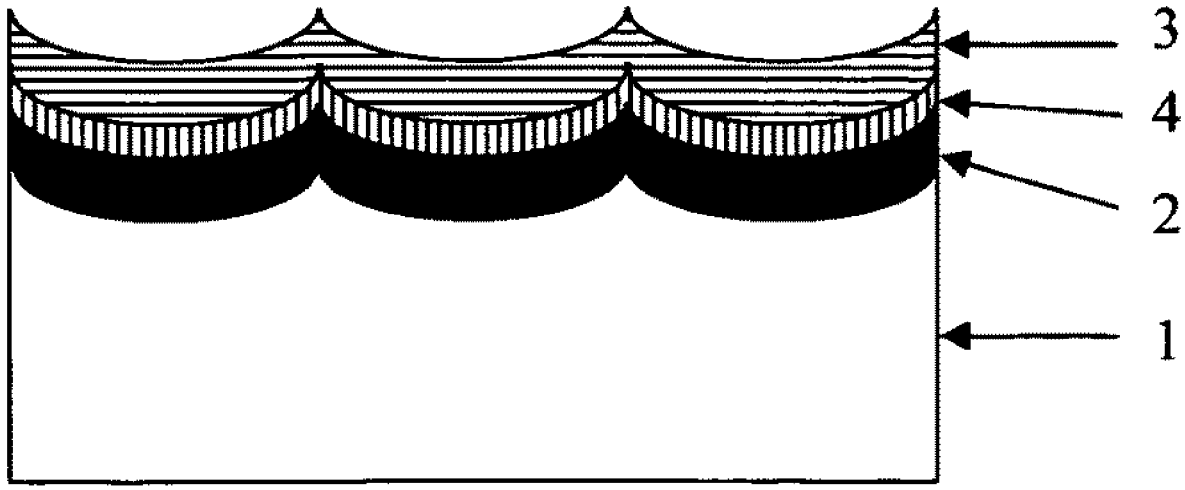
FIG. 1 Conceptual Drawing showing one example of the electrode for electrolysis by the present invention.

FIG. 1 is one example of conceptual diagrams of the electrodes for electrolysis under the present invention.

In the present invention, the electrode substrate 1 comprising valve metal or valve metal alloy is rinsed to remove contaminants on the surface, such as oil and grease, cutting debris, and salts. Available rinsing methods include water washing, alkaline cleaning, ultrasonic cleaning, vapor washing, and scrub cleaning. By further treatments of surface blasting or etching to roughen and enlarge the surface area, the electrode substrate 1 can enhance its bonding strength and reduce electrolytic current density substantially. Etching treatment can enhance a surface cleaning effect more than simple surface cleaning. Etching is performed using non-oxidizing acids, such as hydrochloric acid, sulfuric acid, and oxalic acid or mixed acids of them at or near boiling temperatures, or using nitric hydrofluoric acid near the room temperature. Thereafter, as finishing, rinsing with purified water followed by sufficient drying is performed. Prior to the rinsing with purified water, rinsing with a large volume of tap water is desirable.

In the present specification, "valve metal" refers to titanium, tantalum, niobium, zirconium, hafnium, vanadium, molybdenum, and tungsten. As a typical material for the substrate used for the electrodes comprising valve metal or valve metal alloy under the present invention, titanium or titanium base alloy is applied. Advantages of applying titanium or titanium base alloy includes, in addition to its high corrosion resistance and economy, a large specific strength (strength/specific gravity) and comparatively easy processing operations, such as rolling and cutting, thanks to the recent development of processing technology. Electrodes under the present invention can be either in simple shape of rod or plate or in complicated shape by machine processing. The surface can be either smooth or porous. The 'surface of the electrode' herein referred to means any part which can contact electrolyte when immersed.

Following said operations, the AIP undercoating layer 2 comprising valve metal or valve metal alloy containing crystalline substance of tantalum or titanium component is formed by the AIP method on the surface of the electrode substrate 1 comprising valve metal or valve metal alloy.

Desirable combination of metals to be applied to form the AIP undercoating layer comprising valve metal or valve metal alloy containing crystalline substance of tantalum or titanium component includes tantalum and titanium, or tantalum and titanium plus at least one kind of metals chosen from among three elements of niobium, zirconium and hafnium. When the AIP undercoating layer 2 is formed on the surface of the electrode substrate 1 using these metals by the AIP method, the metals in the AIP undercoating layer 2 will be all of crystalline substance.

The AIP method is a method to form strong and dense coating, in which a metal target (evaporation source) is used as cathode for causing arc discharge in vacuum; generated electric energy instantaneously evaporates and discharges target metal into vacuum; whereas, bias voltage (negative pressure) is loaded on the coating object to accelerate metal ions, which achieves tight adhesion, together with reaction gas particles, to the surface of the coating object.

When the AIP method is applied, ultra hard coating can be prepared using tremendously strong energy of arc discharge.

Moreover, the property of vacuum arc discharge yields high ionization rate of target material, enabling to easily produce dense and highly coherent coating at a high speed.

Dry coating technologies include PVD (Physical Vapor Deposition) and CVD (Chemical Vapor Deposition). The AIP method, being a type of ion plating method as a representative of PVD, is the special ion plating process utilizing vacuum arc discharge.

Therefore, the AIP method yields a high evaporation rate easily. Also, it enables metals with a high fusing point to evaporate or alloy target materials prepared by substances having different vapor pressure to evaporate nearly at the alloy component fraction, which is usually regarded as difficult by other types of ion plating method. The ALP method is the essential method to form the undercoating layer by the present invention.

In the lines, 20-30, right column, p. 2 of said Patent Document 3, it is disclosed, "as a method to form said amorphous layer of such materials on the metallic substrate, the thin coating preparation method by vacuum sputtering is applied. If the vacuum sputtering method is used, thin coating in amorphous state without brain boundary is easy to obtain. For vacuum sputtering, various processes can be applied, such as DC sputtering, high-frequency wave sputtering, ion plating, ion beam plating and cluster ion beam, in which parameters such as degree of vacuum, substrate temperature, component or purity of target plate, deposition rate (input power) can be optionally controlled to obtain thin coating with desired properties." and in Examples 1 and 2, the right column and thereafter, p. 3 of Patent Document 3, the high-frequency wave sputtering is employed. This high-frequency wave sputtering method, however, has the following weak points, unlike the AIP method; the evaporation rate of target metal is low and when alloy target materials are prepared by combining substances having a different fusing point or a vapor pressure, such as tantalum and titanium, formed alloy ratio is not constant.

In Examples 1 and 2, the right column and thereafter, p. 3 of Patent Document 3, the high-frequency wave sputtering is employed. When tantalum and titanium are applied as the target metal for this high-frequency wave sputtering method, however, both metals produced amorphous thin coating. Whereas, all metals became crystalline thin coating by the AIP method in the present invention.

Whereas, by the vacuum sputtering such as DC sputtering, high-frequency wave sputtering, ion plating, ion beam plating, and cluster ion beam, as disclosed in Patent Document 3, the results were same as those by high-frequency wave sputtering, being unable to produce dense and strong coating layer by the AIP method.

The allowable thickness of the AIP undercoating layer 2 comprising valve metal or valve metal alloy containing crystalline tantalum and titanium component usually is 0.1-10 μm, which is optionally chosen from the practical standpoints such as corrosion resistance and productivity.

Then, prior to coating the electrode catalyst layer 3 comprising electrode catalyst on the surface of said AIP undercoating layer 2, the solution of valve metal or valve metal alloy is applied, followed by the heat sintering process and the thermal decomposition process which transforms the tantalum component of the AIP undercoating layer to amorphous state to form the oxide interlayer 4 comprising oxides of valve metal as a chief element.

To form the oxide interlayer 4, oxides mainly containing valve metals as a chief element are applied, including those of pentavalent tantalum, niobium, and vanadium, which constitute valence-controlled semiconductor by being combined with tetravalent titanium substrate; those of pentavalent tantalum, niobium and vanadium oxide combined with hexavalent molybdenum oxide, or those of tetravalent titanium, zirconium, and tin oxide combined with pentavalent tantalum, niobium, vanadium and antimony oxide, which constitute single-phase valence-controlled semiconductor; or n-type semiconductor of nonstoichiometric titanium, tantalum, niobium, tin and molybdenum oxide.

Above all, the most suitable material is the oxide layer by at least one kind of metals chosen from pentavalent tantalum and niobium, or mixed oxide by at least one kind of metal oxides chosen from tetravalent titanium and tin combined with at least one kind of metal oxide chosen from pentavalent tantalum and niobium.

As shown in the examples to be given in the latter part, according to the present invention, when the oxide interlayer 4 containing valve metal oxides component as a chief element is formed, the preferable calcination temperature of said heat sintering process is 530 degrees Celsius or above and the time duration is 40 minutes.

Like this way, formation of the electrode catalyst layer 3 on said oxide interlayer 4 makes the boundary bonding between the AIP undercoating layer 2, the oxide interlayer 4, and the electrode catalyst layer 3 to be further tight. Namely, the steps follow: formation of the AIP undercoating layer 2→application of metal compound solution containing valve metal as the chief element→formation of the oxide interlayer 4 by the heat sintering process→formation of the electrode catalyst layer 3 and by the method: application of metal compound solution containing valve metal as the chief element→heat sintering process, detachment at the interfaces between the AIP undercoating layer 2 and the electrode catalyst layer 3 is prevented.

Moreover, the oxide interlayer 4 containing valve metal as a chief element, prepared by application of metal compound solution containing valve metal as a chief element, followed by the heat sintering process, maintains extremely high bonding effect to both the electrode catalyst layer 3 and the AIP undercoating layer 2 covered with heated oxide coating resulting from the heat sintering process, at their oxide/oxide/oxide bonding interfaces, where respective constituent components are rendered to localized continuation of components by mutual heat diffusion.

This oxide interlayer 4 works as a protection layer of the AIP undercoating layer 2, contributing to enhanced corrosion resistance of the electrode substrate 1, and also provides high effect of bonding with both the AIP undercoating layer 2 and the electrode catalyst layer 3, preventing detachment at the interfaces.

The desirable thickness of said oxide interlayer under the present invention usually is 10 nm or more.

As an example of the thermal decomposition process, solution of tantalum chloride dissolved in hydrochloric acid is applied onto the AIP undercoating layer 2 on the metal titanium substrate 1. When heat treatment by the thermal decomposition process is applied at 550 degrees Celsius or above for at least 60 minutes, the oxide interlayer 4 is formed; at the same time, tantalum component of the AIP undercoating layer 2 becomes amorphous and part of valve metal or valve metal alloy containing tantalum and titanium component is oxidized; on the surface of the AIP undercoating layer 2, oxides interlayer 4 is formed; and the bonding effect with the electrode catalyst layer 3 prepared on the surface by the thermal decomposition process can be enhanced.

The anti-heat deformation effect against thermal oxidation, provided by the AIP undercoating layer in amorphous phase prepared by said heat sintering process, being oxide containing layer having, at the top, dense, extremely thin, high-temperature oxidized coating (oxides interlayer 4), the densification effect by high-temperature oxide coating, and the anchor effect by high-temperature oxide coating not only alleviate thermal effect in the coating process of electrode activation substance to be described, but also alleviate electrochemical oxidation and corrosion of the electrodes while in service, which is expected to greatly contribute to durability of electrodes.

Next, the electrode catalyst layer 3 having precious metal or precious metal oxides as main catalyst is installed on the metal oxide interlayer 4 formed in said manner.

Applied electrode catalyst is suitably selected from among platinum, ruthenium oxide, iridium oxide, rhodium oxide, palladium oxide, etc., to be used singularly or as combined, depending on types of electrolysis. As the electrodes for oxygen generation in which high durability is required against such factors as oxygen generated, low pH, and organic impurities, iridium oxide is the most suitable. In order to enhance adhesiveness to the substrate or durability in electrolysis, it is desirable to mix such materials as titanium oxide, tantalum oxide, niobium oxide, and tin oxide.

Applicable coating methods of this electrode catalyst layer include the thermal decomposition process, the sol-gel process, the paste process, the electrophoresis method, the CVD process, and the PVD process. Above all, the thermal decomposition process as described in detail in JP 48-3954 B and JP 46-21884 B is very suitable, in which chemical compound solution containing elements which constitute main substance of the coating layer is applied on the substrate, followed by drying and heat sintering processing to form aimed oxides through thermal decomposition and thermal synthesis reaction.

As the metal compounds of electrode catalyst layer elements, such substances are listed as metal alkoxide dissolved in organic solution, metal chlorides or nitrate salt dissolved mainly in strong acid aqueous solution and resinate dissolved in grease. To said substances, hydrochloric acid, nitric acid, oxalic acid are added as stabilizing agent, and salicylic acid, 2-ethylhexanoate, acetyl acetone, EDTA, ethanolamine, citric acid, ethylene glycol are optionally added as complexing agent to prepare coating solution, which is applied on the surface of said oxide interlayer using known coating tools and methods including brush, roller, spray; spin coat, printing and electrostatic coating. After drying, heat sintering processing is provided in the furnace of oxidizing atmosphere like in air.

The following are embodiment examples and comparative examples relating to the electrodes for electrolysis and their manufacturing under the present invention, which, however, are not necessarily limited to the present invention.

Example 1

The surface of a JIS 1st class titanium plate is processed with dry blasting by a cast iron grid (G 120 size), followed by acid washing for 10 minutes in aqueous solution of boil-concentrated hydrochloric acid as the cleansing process of electrode substrate. The washed electrode substrate was installed in the arc ion plating unit with a Ti—Ta alloy target as evaporation source, and applied with the Ti—Ta alloy coating onto the surface as an undercoating layer. Coating conditions are shown in Table 1.

TABLE 1

| | |
|---|---|
| Target (evaporation source): | Alloy disk comprising Ta:Ti = 60 wt %:40 wt % (back-surface water-cooled) |
| Time to reach vacuum: | $1.5 \times 10^{-2}$ Pa or less |
| Substrate Temp.: | 500 degrees Celsius or below |
| Coating press.: | $3.0 \times 10^{-1}$~$4.0 \times 10^{-1}$ Pa |
| Evaporation source Input power: | 20~30 V, 140~160 A |
| Coating time: | 15~20 min. |
| Coating thickness: | 2 micron (Weight equivalent) |

The composition of said alloy layer was same as that of the target, from the fluorescent X-ray analysis of the stainless plate installed for inspection in parallel with the electrode substrate.

However, the X-ray diffraction carried out after coating the AIP undercoating layer revealed that clear crystalline peaks were observed in the substrate bulk itself and belonging to the AIP undercoating layer, demonstrating that said undercoating layer comprises crystalline substance of titanium in hexagonal close packing (hcp) and tantalum in body-centered cubic (bcc) with a small quantity of monoclinic system.

Then, coating solution prepared by 5 g/l of tantalum pentachloride dissolved in concentrated hydrochloric acid was applied on said AIP undercoating layer, followed by drying and thermal decomposition for 80 minutes at 525 degrees Celsius in an electric furnace of air circulation type, to form tantalum oxide layer. The X-ray diffraction analysis illustrated broad patterns of tantalum phase belonging to the AIP undercoating layer, evidencing that the tantalum phase of said undercoating layer was transformed from crystalline substance into amorphous one by the thermal treatment. In addition, clear peaks of titanium phase belonging to the titanium substrate and the AIP undercoating layer were observed.

Next, coating solution prepared by tetrachloride iridium and tantalum pentachloride dissolved in concentrated hydrochloric acid was applied on the tantalum oxide interlayer formed on the surface of said AIP undercoating layer, followed by drying and thermal decomposition for 15 minutes at 535 degrees Celsius in an electric furnace of air circulation type, to form electrode catalyst layer comprising mixed oxides of iridium oxide and tantalum oxide. The applied amount of said coating solution was determined so that the coating thickness per treatment becomes approx. 1.0 g/m$^2$ as iridium metal equivalent. The procedure of coating and sintering was repeated twelve times to obtain 12 g/m$^2$ of electrode catalyst layer as iridium metal equivalent.

The X-ray diffraction analysis on this sample illustrated clear peaks of iridium oxide belonging to the electrode catalyst layer and clear peaks of the titanium phase belonging to the titanium substrate and the AIP undercoating layer. Moreover, broad patterns of tantalum phase belonging to the AIP undercoating layer was observed, proving that the tantalum phase of the AIP undercoating layer keeps amorphous state even after the heat sintering process performed to obtain electrode catalyst layer.

The following evaluation of the electrolysis life was carried out for the electrodes for electrolysis prepared in said manner.

Current density: 500 A/dm$^2$

Electrolysis temperature: 60 degrees Celsius

Electrolyte: 150 g/l Sulfuric acid aqueous solution

Counter electrode: Zr plate

The point at which the cell voltage increased by 2.0 V from the initial cell voltage is regarded as the end of electrolysis life.

Table 2 shows the electrolysis life of this electrode.

When the sintering temperature of the heat sintering process in the step of forming the oxide interlayer is set to 530 degrees Celsius or below, compared with Comparative Example 1 of Table 2, the electrode provided with the tantalum oxide interlayer showed an equivalent electrolysis life to the electrode without said interlayer. However, corrosion development at the electrode substrate directly right on the AIP undercoating layer was not same.

Examples 2 & 3

The Ti—Ta alloy coating titanium substrate by the AIP treatment was obtained in the same manner as with Example 1. The coating solution prepared by tantalum pentachloride dissolved in concentrated hydrochloric acid was applied on said AIP undercoating layer, followed by drying and thermal treatment at various temperatures and sintering periods as shown in Table 2 in an electric furnace of air circulation type to form a tantalum oxide interlayer.

After the thermal decomposition, the X-ray diffraction analysis was conducted, from which it was revealed that broad patters of tantalum phase belonging to the AIP undercoating layer were present on all electrodes and that tantalum phase of said undercoating layer had been transformed from crystalline substance into amorphous one by the heat sintering process. In addition, clear peaks of titanium phase belonging to the titanium substrate and the AlP undercoating layer were observed.

Next, electrode catalyst layer was formed in the same manner as Example 1 and evaluation of the electrolysis life was performed in the same procedures.

Figure 2A:
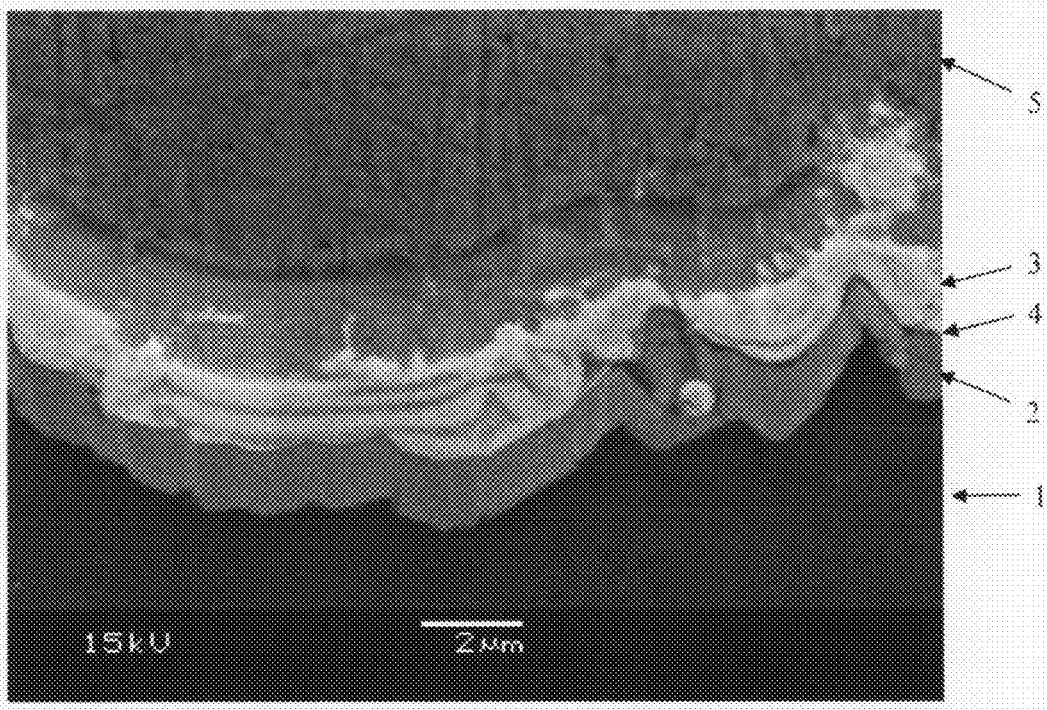
FIG. 2A Sectional SEM Images of electrodes after electrolysis in Example 2 in the present invention.

As known from the results in Table 2, the electrode life was prolonged with increase in sintering temperature and sintering period of the oxide interlayer. FIG. 2A illustrates the section of the electrode of the example 2 by the SEM image after electrolysis. As shown in FIG. 2A, in the electrode of the example 2 after electrolysis, there was no intrusion of electrolyte into the boundary between the substrate and the AIP undercoating layer, and so any corrosion spot is not observed at the substrate.

Equally, in the electrode of the example 3 after electrolysis, there was no intrusion of electrolyte into the boundary between the substrate and the AIP undercoating layer, and so any corrosion spot is not observed at the substrate.

Examples 4-7

The Ti—Ta alloy coating titanium substrate by the AIP treatment was obtained in the same manner with Example 1. The coating solution prepared by tantalum pentachloride dissolved in concentrated hydrochloric acid was applied on said AIP undercoating layer, followed by drying and thermal treatment at various temperatures and sintering periods as shown in Table 2 to form a tantalum oxide interlayer.

After the thermal decomposition, the X-ray diffraction analysis was conducted, from which it was revealed that broad patters of tantalum phase and peaks of tantalum oxide belonging to the AIP undercoating layer were present and that tantalum phase of said undercoating layer had been transformed from crystalline substance into amorphous one and at the same time, partially into oxides ($Ta^2O^5$) by the heat sintering process. In addition, clear peaks of titanium phase belonging to the titanium substrate and the AIP undercoating layer were observed and when the sintering temperature was 575 degrees Celsius or more and the sintering period is 60 minutes or more, peaks of titanium oxide belonging to the AIP undercoating layer was also observed. From these observations, it was known that titanium phase of said undercoating layer was partially oxidized (TiO). In Example 4, however, tantalum oxide only was observed.

Then, the electrode catalyst layer was prepared in the same manner as with Example 1 and the electrolysis life was evaluated in the same procedures. The results of the electrolysis life are given in Table 2.

As known from the results in Table 2, the electrode life was further prolonged, when the sintering temperature was 550 degrees Celsius or more, the sintering period is 60 minutes or more, and the AIP undercoating layer becomes a layer containing oxides.

The change in weight of samples by thermal treatment of the interlayer is shown in the column of "Phase conversion and weight change of components in the undercoating layer by heat treatment of interlayer" in Table 2.

Comparative Example 1

The Ti—Ta alloy coating titanium substrate was obtained by the AIP treatment. The thermal decomposition coating was provided in the electric furnace of air circulation type in the same manner as Example 2, except that the coating of tantalum pentachloride dissolved in concentrated hydrochloric acid solution was applied in Example 2.

The X-ray diffraction analysis revealed that broad patterns of tantalum phase belonging to the alloy undercoating layer were present and that tantalum phase of said undercoating layer had been transformed from crystalline substance to amorphous one by the heat sintering process. In addition, clear peaks of titanium phase belonging to the titanium substrate and the alloy undercoating layer were observed.

Then, the electrode catalyst layer was formed in the same manner as Example 2, and the electrolysis life was evaluated in the same procedures, the results of which are given in Table 2.

Figure 2B:
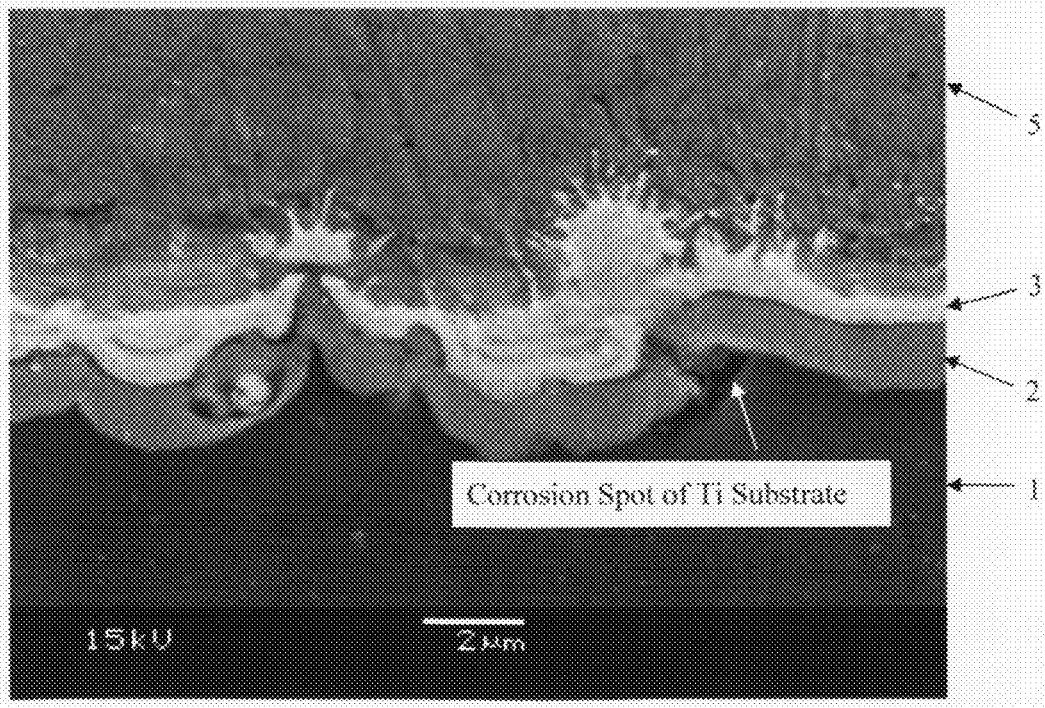
FIG. 2B Sectional SEM Images of electrodes after electrolysis in Comparative Example 1 in the present invention.

It was known that compared with Example 2, the electrode life of comparative example 1 was considerably shortened. The electrode life end was determined as the time when the voltage increased by 2V from the start of the electrolysis which was run in simulated severe operating conditions. FIG. 2B illustrates the section of the electrode of the comparative example 1 by the SEM image after electrolysis. As shown in FIG. 2B, in the electrode of the comparative example 1 after electrolysis, corrosion is observed at the substrate caused by intrusion of electrolyte into the boundary between the substrate and the AIP undercoating layer through the cracks of the AIP under coating layer with some traces of cracking accelerated. On the contrary, no corrosion spots on the substrate were observed in Example 2, even if cracking existed in the AIP undercoating layer. This phenomenon is commonly confirmed in all cases of examples and comparative examples. From these observations, it is known that the oxide interlayer functions to prevent electrolyte from intruding into cracks by faulting, thus controlling corrosion of the substrate.

Comparative Example 2

The Ti—Ta alloy coating titanium substrate was obtained by the AIP treatment. The thermal decomposition coating was provided in the electric furnace of air circulation type in the same manner as with Example 5, except that the coating of tantalum pentachloride dissolved in concentrated hydrochloric acid solution was not applied.

The X-ray diffraction analysis revealed that broad patterns of tantalum phase and peaks of tantalum oxide belonging to the AIP undercoating layer were present in all electrodes and that tantalum phase of said undercoating layer had been transformed by the heat sintering process from crystalline substance to amorphous one and partially to oxides.

Then, the electrode catalyst layer was formed in the same manner as Example 5, and the electrolysis life was evaluated in the same procedures. As shown in the column of sulfuric acid electrolysis life of Table 2, life came in only 1802 hours, compared with 2350 hours of Example 5, proving that provision of the tantalum interlayer enhances electrolytic durability of electrodes.

Comparative Example 3

The Ti—Ta alloy coating titanium substrate was obtained by the AIP treatment. The electrode catalyst layer was provided directly on the AIP undercoating layer in the same manner as Example 2, except that the coating of tantalum pentachloride dissolved in concentrated hydrochloric acid solution and the thermal treatment in the electric furnace of air circulation type were not applied. The electrolysis life was evaluated in the same manner.

The electrolysis life came in only 1637 hours, compared with 1952 hours of Example 2, where the oxide interlayer was prepared by the thermal treatment for 180 minutes at 530 degrees Celsius.

Also it did not reach even 1790 hours of Comparative Example 1 in which only thermal treatment at 530 degrees Celsius for 180 hours was provided without installing the oxide interlayer. From these comparisons, it is known that both elements of the thermal treatment of AIP undercoating layer and the oxide interlayer contribute to enhancing the electrolysis life of electrodes.

Comparative Example 4

As with Example 1, using titanium substrate treated with blast and acid cleansing, but without Ti—Ta alloy coating by the AIP treatment, coating solution of tantalum pentachloride dissolved in concentrated hydrochloric acid was provided directly on the titanium substrate, followed by drying and thermal decomposition coating under heat treatment conditions of the same as Example 2 in the electric furnace of air circulation type to form tantalum oxide layer. The electrolysis life was evaluated by the same method and only 1320 hours of the electrolysis life resulted in and therefore, the cell voltage has risen sharply.

TABLE 2

| Ti/Ta AIP alloy undercoating layer | | | | | | | |
|---|---|---|---|---|---|---|---|
| | | | Heat sintering process conditions | | | | |
| | substrate | Undercoating layer | Ta/Ti conc. (g/l) | sintering temp. (degrees Celsius) | sintering time (min) | Sulfuric acid electrolysis life (h) | Phase conversion and weight change of components in the undercoating layer by heat treatment of interlayer |
| Example 1 | Ti plate | AIP undercoating layer of Ti/Ta | 5/0 | 525 | 80 | 1782 | Ta phase: crystalline→amorphous<br>Ti phase: crystalline substance preserved<br>1.76 g/m2 |
| Example 2 | | | 7/0 | 530 | 180 | 1952 | Ta phase: crystalline→amorphous<br>Ti phase: crystalline substance preserved<br>2.49 g/m2 |
| Example 3 | | | 5/0 | 550 | 30 | 1967 | Ta phase: crystalline→amorphous<br>Ti phase: crystalline substance preserved<br>1.77 g/m2 |
| Example 4 | | | 1/0 | 550 | 80 | 2196 | Ta phase: crystalline→amorphous, Ta2O5<br>Ti phase: crystalline substance preserved<br>2.09 g/m2 |
| Example 5 | | | 7/0 | 575 | 80 | 2350 | Ta phase: crystalline→amorphous, Ta2O5<br>Ti phase: crystalline substance preserved, TiO<br>3.03 g/m2 |
| Example 6 | | | 5/0 | 600 | 130 | 2519 | Ta phase: crystalline→amorphous, Ta2O5<br>Ti phase: crystalline substance preserved, TiO<br>4.29 g/m2 |
| Example 7 | | | 1/0 | 600 | 180 | 2614 | Ta phase: crystalline→amorphous, Ta2O5<br>Ti phase: crystalline substance preserved, TiO<br>4.88 g/m2 |
| Comparative Example 1 | Ti plate | AIP undercoating layer of Ti/Ta | — | 530 | 180 | 1790 | Ta phase: crystalline→amorphous<br>Ti phase: crystalline substance preserved<br>2.12 g/m2 |
| Comparative Example 2 | | | — | 575 | 80 | 1802 | Ta phase: crystalline→amorphous, Ta2O5<br>Ti phase: crystalline substance preserved, TiO<br>2.08 g/m2 |

TABLE 2-continued

| Ti/Ta AIP alloy undercoating layer | | | | | | | |
|---|---|---|---|---|---|---|---|
| | | | Heat sintering process conditions | | | | |
| | substrate | Undercoating layer | Ta/Ti conc. (g/l) | sintering temp. (degrees Celsius) | sintering time (min) | Sulfuric acid electrolysis life (h) | Phase conversion and weight change of components in the undercoating layer by heat treatment of interlayer |
| Comparative Example 3 | | | — | — | — | 1637 | Ta phase: crystalline substance preserved<br>Ti phase: crystalline substance preserved<br>0 g/m2 |
| Comparative Example 4 | | Without under coating | 5/0 | 575 | 80 | 1321 | 1.34 g/m2 |

As mentioned above, according to the present invention, the AIP undercoating layer comprising valve metal or valve metal alloy containing crystalline tantalum component and crystalline titanium component is formed on the surface of the electrode substrate comprising valve metal or valve metal alloy by the AIP method, and then, metal compound solution containing valve metal component as a chief element is coated on the surface of the AIP undercoating layer, followed by the heat sintering process to transform tantalum component of the AIP undercoating layer into amorphous state, at the same time to form the oxide interlayer comprising valve metal oxides component as a chief element and the heat sintering process to form the electrode catalyst layer on the surface of the oxide interlayer. By the heat sintering process to form the oxide interlayer, layers including the AIP undercoating layer and respective interfaces are strengthened. Namely, crystalline planes do not essentially exist in amorphous phase of tantalum component of the AIP undercoating layer and movement and proliferation of dislocation do not occur, and therefore, neither grow of crystalline grain by the heat sintering process to form the electrode catalyst layer nor thermal deformation by movement of dislocation occurs. Thermal deformation will occur only to titanium component in crystalline phase, being alleviated to the AIP undercoating layer on the whole.

Thermal deformation of the AIP undercoating layer appears in the form of changes in surface shape or structure, leaving potential risk of gap formation between the AIP undercoating layer and the electrode catalyst layer laminated by the heat sintering process. Transformation of the AIP undercoating layer into amorphous will reduce said potential risk.

Also, regarding titanium component of crystalline phase in the AIP undercoating layer, the heat sintering process to form oxide interlayer results in lessening internal stress, a cause of deformation in the future, working as annealing, and therefore, thermal deformation by the heat sintering process to form electrode catalyst layer is lessened by that much, since in the AIP undercoating layer right after the AIP treatment of electrode substrate, a large internal stress remains just like other physical or chemical vapor deposition and plating.

However, growth of crystalline grain or movement and proliferation of dislocation, which cause said deformation are one of phenomena brought about during heating. The process of rapid heating to rapid cooling frequently repeated in the heat sintering process to form the oxide interlayer and the electrode catalyst layer will give a large impact on the AIP undercoating layer having a thermal expansion coefficient different from that of the substrate.

It is known that the AIP undercoating layer and the substrate are tightly bonded at the atomic level and then, the thermal impact will be loaded on weaker parts of the AIP undercoating layer, unavoidably generating fault in the AIP undercoating layer.

In the heat sintering process to form the oxide interlayer, the oxide layer containing valve metal components as a chief element, prepared by coating of metal compounds solution containing valve metal components as a chief element, followed by the heat sintering process is of "flexible structure" with micro pores from which thermally decomposed elements have been voided. Thus, having some following capacity to the fault of the AIP undercoating layer, the oxide interlayer is formed on the AIP undercoating layer so as to cover the fault in it. The oxide layer not only works to prevent electrode catalyst components from intruding into the fault, when the electrode catalyst layer is formed successively, but also works to prevent electrolyte from intruding into the fault when the electrodes are actually servicing as those for electrolysis operation.

The reason is that with increased consumption of catalyst component of the electrode catalyst layer, micro pores enlarge due to thermally decomposed and voided components; however, the size of micro pores of the oxide interlayer containing valve metal components as a chief element do not change. Therefore, corrosion development on the substrate during electrolysis which may be caused by electrolyte having reached the boundary between the substrate and the AIP undercoating layer can be suppressed. It has been proven through experiments that such function is more strengthened when the oxide layer with valve metal components as a chief element has been formed at multiple times and when the life of electrodes is judged at the time of voltage increase by 2V from the operation start under severe conditions of electrolysis simulation, rather than at the time of voltage increase by 1V.

The oxide layer containing valve metal components as a chief element formed by coating solution of metal compounds containing valve metal components as a chief element, followed by the heat sintering process demonstrates extremely good bonding property with the AIP undercoating layer coated with high temperature oxide film produced through the heat sintering process, since constituent components of them thermally diffuse mutually at the joint interface between said high temperature oxide film and oxides, resulting in local continuation of constituent components. This oxide interlayer, unified with the high temperature oxide coating of the AIP undercoating layer enhances anti-corrosion property of the electrode substrates as a protective layer to reinforce and also suppresses detachment phenomenon at the interfaces, maintaining good bonding property to both the AIP undercoating layer and the electrode catalyst layer based on locally continued constituent components obtained from mutual thermal diffusion at oxide/oxide bonding interface.

Moreover, according to the present invention, when the oxide interlayer with valve metal components as a chief element is formed by the heat sintering process, intensity of this oxide interlayer is able to be increased by applying sintering conditions of temperature at 530 degrees Celsius or more and of time for 40 minutes or more, which lead to reinforced bonding with high temperature oxide coating on the AIP undercoating layer. As a result of said intensified effect, intrusion of electrolyte into faults of the AIP undercoating layer is suppressed to protect the electrode substrate and the electrode life can be prolonged.

Furthermore, according to the present invention, in the heat sintering process to form the oxide interlayer containing valve metal components as a chief element, if the sintering temperature is set at 550 degrees Celsius or more and the sintering time for 60 minutes or more; tantalum component of the AIP undercoating layer is transformed into amorphous; and the valve metal components are partially oxidized, the AIP undercoating layer becomes oxides-contained layer and the high temperature oxide coating produced on the surface of the AIP undercoating layer bonds with part of oxides contained as widely dispersed in the AIP undercoating layer, achieving stronger bonding with the AIP undercoating layer by the "anchor effect". As a result of said intensified effect, faults of the AIP undercoating layer and the electrode substrates are protected from intrusion of electrolyte and thus the electrode life can be prolonged, enduring severe electrolysis environment.

The oxide interlayer comprising oxides containing valve metal components as a chief element owns high protective action towards the electrode substrates comprising valve metal or valve metal alloy coated by the AIP undercoating layer and the AIP undercoating layer; and therefore, even if the electrodes are used up to its life end, the electrode substrate comprising valve metal or valve metal alloy coated with the AIP undercoating layer is expected to be re-used as an integral component, without removing expensive AIP undercoating layer, at recycling time.

The invention claimed is:

1. A process for manufacturing electrodes for electrolysis, comprising the steps of:

forming an arc ion plating undercoating layer comprising valve metal comprising a crystalline tantalum component and a crystalline titanium component or valve metal alloy comprising a crystalline tantalum component and a crystalline titanium component on a surface of an electrode substrate comprising valve metal or valve metal alloy, by an arc ion plating method;

heat sintering, comprising coating a metal compound solution, comprising one or more of titanium, tantalum, niobium, zirconium, hafnium, vanadium, molybdenum, and tungsten, onto a surface of said arc ion plating undercoating layer, followed by heat sintering to transform only said tantalum component of said arc ion plating undercoating layer into an amorphous substance, and to form an oxide interlayer, comprising an oxide of one or more of titanium, tantalum, niobium, zirconium, hafnium, vanadium, molybdenum, and tungsten, on said surface of said arc ion plating undercoating layer containing said transformed amorphous tantalum component and said crystalline titanium component; and forming an electrode catalyst layer for electrolysis, said electrode catalyst layer comprising one or more of precious metals and precious metal oxides, on a surface of said oxide interlayer.

2. A process for manufacturing electrodes for electrolysis according to claim 1, wherein a sintering temperature of said heat sintering is 530 degrees Celsius or more, and a sintering duration of said heat sintering is 40 minutes or more.

3. A process for manufacturing electrodes for electrolysis according to claim 1, wherein a sintering temperature of said heat sintering is 550 degrees Celsius or more, and a sintering duration of said heat sintering is 60 minutes or more; and only said tantalum component of said arc ion plating undercoating layer is transformed into said amorphous substance, and said valve metal or valve metal alloy of said arc ion plating undercoating layer is partially transformed into oxides.

4. A process for manufacturing electrodes for electrolysis according to claim 1, wherein a thermal decomposition process is applied to form said electrode catalyst layer.

5. A process for manufacturing electrodes for electrolysis according to claim 1, wherein said electrode substrate comprising said valve metal or valve metal alloy is titanium or titanium base alloy.

6. A process for manufacturing electrodes for electrolysis according to claim 1, wherein said valve metal or valve metal alloy forming said arc ion plating undercoating layer further comprises at least one of niobium, zirconium, and hafnium.

* * * * *